US007455546B1

(12) United States Patent
Yoon et al.

(10) Patent No.: US 7,455,546 B1
(45) Date of Patent: Nov. 25, 2008

(54) ELECTRICAL POWER STRIP PLUG RETENTION

(75) Inventors: Seunghyun Yoon, Phoenixville, PA (US); Peter Klein, Phoenixville, PA (US)

(73) Assignee: Unisys Corporation, Blue Bell, PA (US)

( * ) Notice: Subject to any disclaimer, the term of this patent is extended or adjusted under 35 U.S.C. 154(b) by 0 days.

(21) Appl. No.: 11/895,915

(22) Filed: Aug. 28, 2007

(51) Int. Cl.
*H01R 13/64* (2006.01)
*H01R 13/62* (2006.01)

(52) U.S. Cl. ..... 439/373; 439/369

(58) Field of Classification Search ..... 439/369, 439/371, 373, 214
See application file for complete search history.

(56) References Cited

U.S. PATENT DOCUMENTS

| | | | |
|---|---|---|---|
| 2,089,665 | A | 8/1937 | Roberts et al. |
| 2,240,050 | A | 4/1941 | Nuebling |
| 2,406,567 | A | 8/1946 | Schueneman |
| 2,415,602 | A | 2/1947 | Monaco |
| 2,526,606 | A | 10/1950 | Gregg |
| 2,559,151 | A | 7/1951 | Getzoff |
| 2,675,530 | A | 4/1954 | Sadasky |
| 2,725,543 | A | 11/1955 | Tanner |
| 2,728,058 | A | 12/1955 | Phalen |
| 2,913,791 | A | 11/1959 | Martin |
| 2,942,226 | A | 6/1960 | Low |
| 3,014,194 | A | 12/1961 | Berglund |
| 3,048,810 | A | 8/1962 | Steen |
| 3,163,481 | A | 12/1964 | Salvador |
| 3,475,716 | A | 10/1969 | Laig |
| 3,475,810 | A | 11/1969 | Mates |
| 3,499,102 | A | 3/1970 | Gillemot et al. |
| 3,659,248 | A | 4/1972 | Mann et al. |
| 3,775,729 | A | 11/1973 | Casper |
| 3,828,302 | A | 8/1974 | Cieniawa et al. |
| 3,838,383 | A | 9/1974 | Wilbur et al. |
| 3,960,432 | A | 6/1976 | Wilbur |
| 4,043,627 | A | 8/1977 | Ayer |
| 4,045,108 | A | 8/1977 | Olsen |
| 4,083,618 | A | 4/1978 | Busch, Jr. |
| 4,097,105 | A | 6/1978 | Zumwalt |
| 4,105,274 | A | 8/1978 | Casey |
| 4,157,856 | A | 6/1979 | Shevchuk |
| 4,165,142 | A | 8/1979 | Grabau |
| 4,183,603 | A | 1/1980 | Donarummo |
| 4,221,449 | A | 9/1980 | Shugart, Jr. |
| 4,302,624 | A | 11/1981 | Newman |
| 4,343,525 | A | 8/1982 | Knickerbocker |
| 4,424,407 | A | 1/1984 | Barbic |
| 4,457,571 | A | 7/1984 | Lavine et al. |
| 4,463,999 | A | 8/1984 | Knickerbocker |

(Continued)

*Primary Examiner*—Javaid Nasri
(74) *Attorney, Agent, or Firm*—Richard J. Gregson; Robert P. Marley; Ratner Prestia

(57) ABSTRACT

Electrical power strips and electrical power strip assemblies are disclosed. An electrical power strip assembly includes electrical outlets for receiving power cord plugs. Strap mounts are provided, wherein each strap mount includes a connection point associated with one of the electrical outlets. A housing supports the electrical outlets in a connection plane and supports the plurality of strap mounts. Each strap mount connection point is proximal to the connection plane and to the electrical outlet associated with that strap mount connection point. Straps are coupled to the strap mounts. Each strap is configured to releasably secure a power cord plug received by one of the electrical outlets to the associated strap mount at the connection point.

18 Claims, 5 Drawing Sheets

U.S. PATENT DOCUMENTS

| | | | | |
|---|---|---|---|---|
| 4,566,185 | A | 1/1986 | Bryan et al. | |
| 4,618,200 | A | 10/1986 | Roberts et al. | |
| 4,652,069 | A | 3/1987 | Smith | |
| 4,690,476 | A | 9/1987 | Morgenrath | |
| 4,702,540 | A | 10/1987 | Siemon | |
| 4,702,709 | A | 10/1987 | Santilli | |
| 4,773,874 | A | 9/1988 | Kopeski, Jr. | |
| 4,789,353 | A | 12/1988 | Busta et al. | |
| 4,917,626 | A | 4/1990 | Barton | |
| 4,957,450 | A | 9/1990 | Pioszak | |
| 5,011,427 | A | 4/1991 | Martin | |
| 5,044,976 | A | 9/1991 | Thompson | |
| 5,104,335 | A | 4/1992 | Conley et al. | |
| 5,110,303 | A | 5/1992 | Hardy | |
| 5,273,454 | A | 12/1993 | Hester | |
| 5,299,099 | A | 3/1994 | Archambault | |
| 5,336,107 | A | 8/1994 | Sheryll | |
| 5,348,495 | A | 9/1994 | Kasden | |
| D372,461 | S | 8/1996 | Kenney | |
| 5,547,390 | A | 8/1996 | Laherty | |
| 5,575,677 | A | 11/1996 | Buckner et al. | |
| 5,655,924 | A | 8/1997 | Cross et al. | |
| 5,722,847 | A | 3/1998 | Haag | |
| 5,732,445 | A | 3/1998 | Stodolka et al. | |
| 5,733,138 | A | 3/1998 | Kramer | |
| 5,876,234 | A | 3/1999 | Hester | |
| 5,928,023 | A | 7/1999 | Buckner et al. | |
| 5,934,919 | A | 8/1999 | Cross et al. | |
| 5,989,052 | A | 11/1999 | Fields et al. | |
| 6,033,251 | A | 3/2000 | Cook | |
| 6,071,142 | A | 6/2000 | Blackman | |
| 6,080,010 | A | 6/2000 | Daoud | |
| 6,095,846 | A | 8/2000 | Becerra | |
| 6,135,803 | A | 10/2000 | Kovacik et al. | |
| 6,196,859 | B1 | 3/2001 | Garlarza | |
| 6,217,366 | B1 | 4/2001 | Weisstock | |
| 6,478,601 | B2 | 11/2002 | Oswald | |
| 6,491,539 | B1 | 12/2002 | Johnston | |
| D474,156 | S | 5/2003 | Vournou | |
| D495,999 | S | 9/2004 | Lewis | |
| 6,802,725 | B2 | 10/2004 | Rowland et al. | |
| 6,948,963 | B2 | 9/2005 | Burton | |
| 6,966,792 | B1 | 11/2005 | Willers et al. | |
| 6,997,734 | B1 | 2/2006 | McQuirter | |
| 7,001,202 | B2 | 2/2006 | Robbins | |
| 7,077,683 | B1 | 7/2006 | Ross | |
| 7,101,215 | B2 * | 9/2006 | Woellner et al. | 439/371 |
| 7,125,277 | B2 | 10/2006 | Wascow et al. | |
| 7,140,903 | B2 | 11/2006 | Pulizzi et al. | |
| 7,168,973 | B2 | 1/2007 | Wascow et al. | |
| 7,172,456 | B1 | 2/2007 | Nagy | |
| 7,192,298 | B2 | 3/2007 | Sinner et al. | |
| 2004/0166718 | A1 | 8/2004 | Yoest | |
| 2006/0160384 | A1 | 7/2006 | Brazina | |
| 2006/0172584 | A1 | 8/2006 | Hidalgo | |
| 2007/0054538 | A1 | 3/2007 | Smith et al. | |

* cited by examiner

ELECTRICAL POWER STRIP PLUG RETENTION

FIELD OF THE INVENTION

The present invention relates to electrical power strips and, more particularly, to the retention of power cord plugs plugged into electrical power strips.

BACKGROUND OF THE INVENTION

Electrical power strips are utilized to distribute electrical power to various devices, such as desktop computers, servers, and rack systems. These electrical power strips generally have multiple outlets, which are engaged by the power cord plugs of the various devices.

Power cord plugs may inadvertently or unintentionally become disengaged from a power strip. Contributing to this problem is low mating forces between the power cord plug and the electrical power outlet of the power strip.

SUMMARY OF THE INVENTION

The present invention relates to an electrical power strip assembly for retaining power cord plugs. According to one aspect of the invention, an electrical power strip assembly is provided. The electrical power strip assembly includes electrical outlets for receiving power cord plugs. Strap mounts are also provided. Each strap mount includes a connection point associated with one of the electrical outlets. A housing defining a connection plane supports the electrical outlets in the connection plane and supports the strap mounts. Each strap mount connection point is proximal to the connection plane and to the electrical outlet associated with that strap mount connection point. Straps are coupled to the strap mounts to releasably secure a power cord plug received by one of the electrical outlets to the associated strap mount at the connection point.

According to another aspect of the invention, an electrical power strip is provided. The electrical power strip includes electrical outlets for receiving power cord plugs. Strap mounts are associated with respective electrical outlets. Each strap mount includes a connection point associated with one of the electrical outlets for receiving a strap to releasably secure a power cord plug received by the associated electrical outlet. A housing defining a connection plane supports the electrical outlets in the connection plane and supports the strap mounts. Each strap mount connection point is proximal to the connection plane and to the electrical outlet associated with that strap mount connection point.

BRIEF DESCRIPTION OF THE DRAWINGS

The invention is best understood from the following detailed description when read in connection with the accompanying drawings, with like elements having the same reference numerals. When a plurality of similar elements are present, a single reference numeral may be assigned to the plurality of similar elements with a small letter designation referring to specific elements. When referring to the elements collectively or to a non-specific one or more of the elements, the small letter designation may be dropped. This emphasizes that according to common practice, the various features of the drawings are not drawn to scale. On the contrary, the dimensions of the various features are arbitrarily expanded or reduced for clarity. Included in the drawings are the following figures.

DETAILED DESCRIPTION OF THE INVENTION

Although the invention is illustrated and described herein with reference to specific embodiments, the invention is not intended to be limited to the details shown. Rather, various modifications may be made in the details within the scope and range of equivalents of the claims and without departing from the invention.

Figure 1:
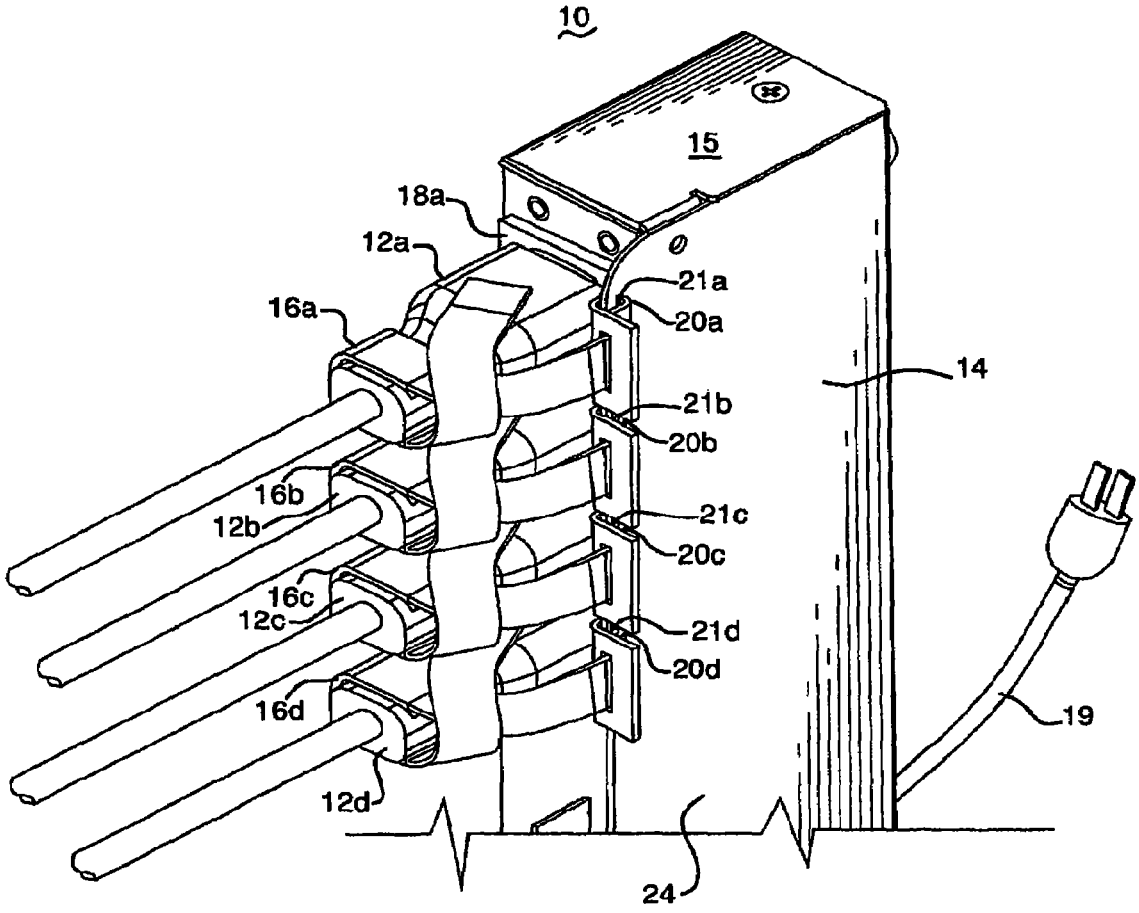
FIGS. 1 and 2 depict partial perspective views of an exemplary electrical power strip assembly and a plurality of power cord plugs mounted to the electrical power strip assembly according to aspects of the invention.
Figure 2:
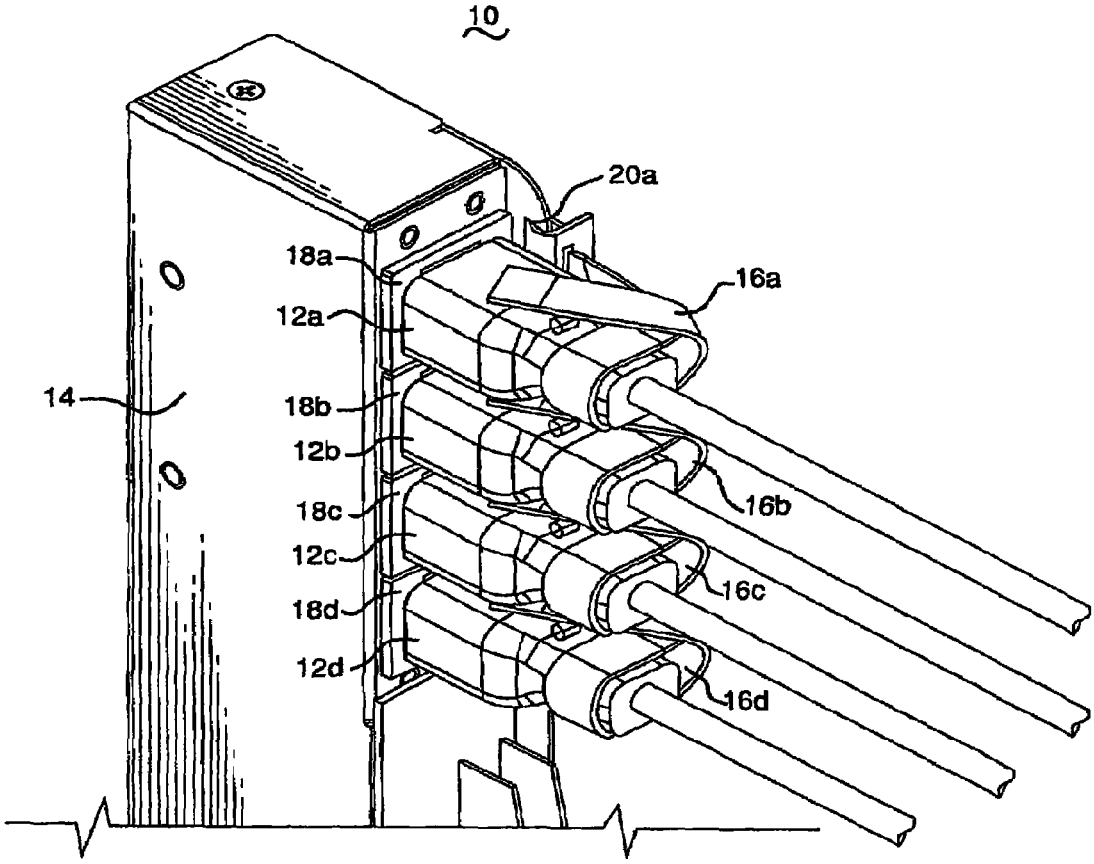

FIGS. 1 and 2 depict partial perspective views of an exemplary electrical power strip assembly 10 for retaining and supplying power to multiple power cord plugs (represented by four power cord plugs 12*a-d* in the illustrated embodiment) according to one aspect of the present invention. The illustrated electrical power strip assembly 10 includes an electrical power strip 14 (also referred to herein as power strip 14) and multiple straps (represented by four straps 16*a-d* in the illustrated embodiment) mounted to the power strip 14. In an exemplary embodiment, the straps 16 are releasably mounted to the power strip 14. In alternative exemplary embodiments, the straps 16 may be permanently mounted to the power strip 14.

The power strip 14 includes multiple electrical outlets (represented by four electrical outlets 18*a-d* in the illustrated embodiment). The illustrated electrical outlets 18 each accept a single power cord plug 12. The straps 16 are configured to releasably secure a power cord plug 12 to one of the electrical outlets 18. It is to be understood that the power cord plugs 12 are not a component of the electrical power strip assembly 10.

The illustrated electrical power strip 14 includes a housing 15 having a substantially rectangular shape and a hollow interior for accommodating the electrical outlets 18 and associated circuitry, wires, and other hardware. Although four electrical outlets 18 are depicted, the electrical power strip 14 may include more or fewer electrical outlets 18. The electrical power strip 14 further includes a conventional power cord plug 19 that is electrically coupled to each electrical outlet 18 (electrical coupling not shown). The power cord plug 19 of the power strip 14 is adapted for insertion into a conventional electrical wall outlet (not shown) to provide electrical power to the electrical outlets 18.

The housing 15 supports multiple strap mounts (represented by four strap mounts 20*a-d*) in the illustrated embodiment. Straps 16 are mounted to the strap mounts 20 at connection points (represented by four connection points 21*a-d*). Each connection point 21 is associated with one of the electrical outlets 18. For example, connection point 21*a* is associated with electrical outlet 18*a*. In use, the straps 16 are wrapped around the power cord plugs 12 to retain the power cord plugs 12 in the electrical outlets 18 such that the power cord plugs 12 are prevented from being unintentionally or inadvertently disengaged from the electrical outlets 18.

Figure 3:
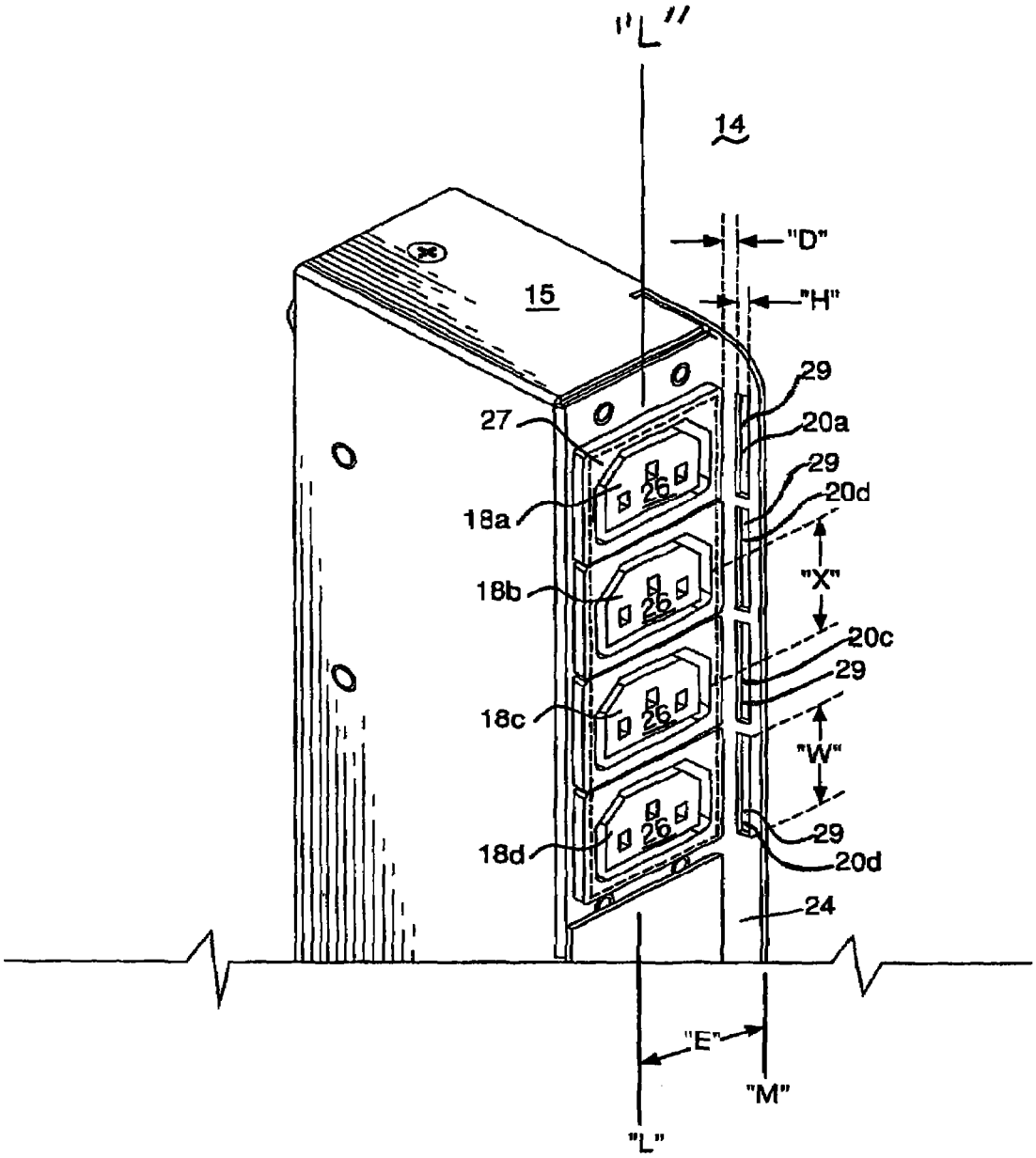
FIGS. 3 and 4 depict partial perspective views of the electrical power strip of FIG. 1 according to aspects of the invention.
Figure 4:
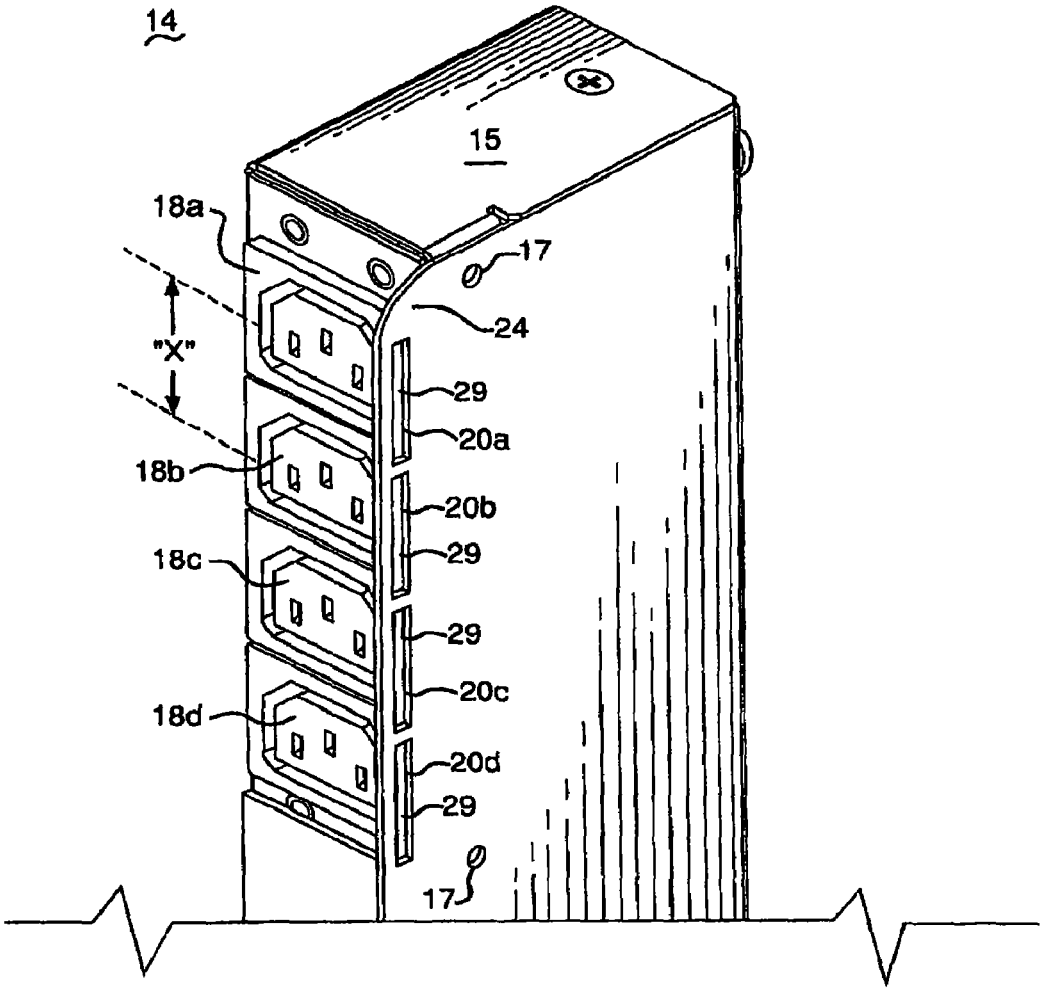

FIGS. 3 and 4 depict partial perspective views of the electrical power strip 14 of FIGS. 1 and 2 without the straps 16 attached to the strap mounts 20. The power cord 19 of the power strip 14 is omitted in FIGS. 3 and 4. The electrical power strip 14 includes a housing 15 and electrical outlets 18 positioned within the housing 15. The housing defines a connection plane 27 and supports the electrical outlets 18 such that their mating surfaces 26 reside in the connection plane 27.

The illustrated housing includes a flange 24 extending in a direction substantially orthogonal with respect to the connection plane 27. The flange 24 may be integral with the housing 15, or a separate component mounted to the housing 15, e.g., by a series of fasteners 17, as best shown in FIG. 4. In alternative embodiments, the flange 24 may be positioned flush with the connection plane 26, or oriented at any other angle with respect to the connection plane 26.

The illustrated strap mounts 20 include apertures and, more particularly, rectangular slots 29 disposed along the flange 24. Each strap mount 20 accommodates a strap 16, as shown in FIGS. 1 and 2. Although the illustrated strap mounts 20 include rectangular slots 29, other aperture shapes, such as circular, elliptical, or other desired shape, may be used. Alternatively, the strap mounts 20 may include other means for engaging the straps 16, e.g., a hook material, a loop material, a button, a plug, a releasable adhesive, a post, a fastener, a magnet, a releasable adhesive, a strap, or essentially any fastening means. It follows that the strap 16 may also vary from that shown in FIGS. 1 and 2, so long as the strap 16 is able to engage the strap mount 20.

A strap 16 is mounted to the strap mount 20 at the connection point 21 of that strap mount 20. Each strap mount connection point 21 is associated with one of the plurality of electrical outlets 18. More particularly, and according to one aspect of the invention, adjacent electrical outlets 18 are separated by a predetermined distance "X" along the longitudinal axis "L" of the housing 15. Adjacent strap mounts 20 are also separated by the same predetermined distance "X." Each strap mount 20 is substantially aligned with an electrical outlet 18 along the longitudinal axis "L" of the housing 15. By aligning each strap mount 20 with an electrical outlet 18, each strap mount connection point 21 is associated with one of the plurality of electrical outlets 18.

Each strap mount connection point 21 is positioned proximal to the connection plane 26 and proximal to the electrical outlet 18 associated with that strap mount connection point. In an exemplary embodiment utilizing slots 29 (as best shown in FIG. 3), each slot 29 includes a width dimension "W" and a height dimension "H" that is orthogonal to the width dimension "W." According to this exemplary embodiment, the width dimension "W" is greater than the height dimension "H." The width dimension "W" of the slot 29 is also greater than the distance "D" separating the connection plane 26 of the power strip 14 and the boundaries of the slot 29. By maintaining a width dimension "W" of each slot 29 greater than the distance "D," each strap mount connection point is positioned proximal to the connection plane 26.

Furthermore, the electrical outlets 18 are arranged along a longitudinal axis "L" of the housing 15 and the connection points 21 of the strap mounts 20 are arranged along a mounting axis "M" that is parallel to the longitudinal axis "L." The mounting axis "M" is separated from the longitudinal axis "L" by a dimension "E" that includes at least one directional component that is parallel to the connection plane 26. By maintaining the parallel component of dimension "E" as small as possible, but large enough to accommodate a power cord plug 12, and minimizing any perpendicular component, each strap mount connection point is positioned proximal to its associated electrical power outlet 18.

Figure 5:
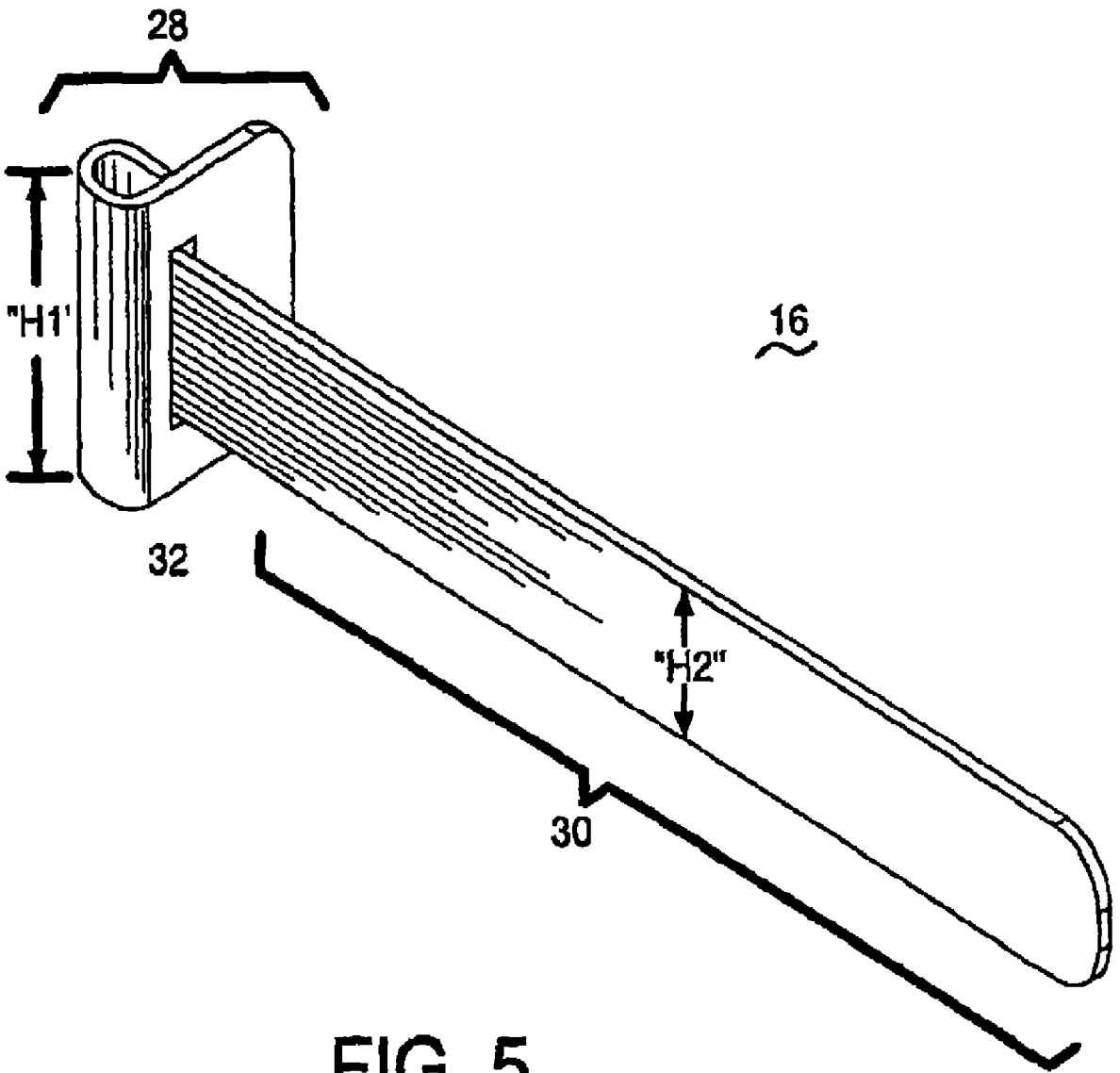
FIG. 5 depicts a perspective view of the strap of FIG. 1 according to aspects of the invention.

FIG. 5 depicts a perspective view of the strap 16 of FIG. 1. In an exemplary embodiment, the strap 16 is a strip of material having loop material on one side and hook material on the opposing side for engagement with the loop material.

The strap 16 includes a mounting portion 28, in the form of a loop, for mounting to a strap mount 20 of the power strip 14 at a connection point, and an extended portion 30 for releasably securing a power cord plug 12. An aperture 32 is formed in the mounting portion 28 of the strap. The height dimension "H1" of the mounting portion 28 of the strap 16 is greater than the height dimension "H2" of the extended portion 30 to accommodate the height of the aperture 32.

In use, the extended portion 30 is inserted through the slot 29 of the power strip 14. The extended portion 30 is then inserted through the aperture 32 of the strap 16 thereby forming a loop around the slot 29. The extended portion 30 of the strap 16 is then wrapped around a power cord plug 12 and releasably fastened to itself, thereby securing the power cord plug 12 to the power strip 14, as best shown in FIGS. 1 and 2.

According to the exemplary embodiment shown in FIG. 5, a portion of each extended portion 30 is formed from a hook material and another portion of the extended portion 30 is formed from a loop material. For example, one side of the extended portion 30 is formed from a hook material and the opposing side of the extended portion 30 is formed from a loop material. It should be understood that loop material is releasably engageable with hook material.

The mounting portion 28 of the strap 16 is not limited to a loop. By way of non-limiting example, the mounting portion 28 may comprise a button, a connector, a releasable adhesive, a fastener, an aperture, a snap, a plug, hook material, loop material, or any other means for fastening known in the art, so long as the mounting portion 28 is engageable with the strap mount 20 of the power strip 14.

The strap 16 and strap mount 20 arrangement disclosed herein possesses several benefits over prior art power cord retention solutions for power strips 14. Unlike the prior art power cord retention solutions that are intended for use with an often non-conventional single power cord plug style, the strap 16 described herein may be fastened around any conventional or non-conventional power cord plug.

While exemplary embodiments of the invention have been shown and described herein, it will be understood that such embodiments are provided by way of example only. Numerous variations, changes and substitutions will occur to those skilled in the art without departing from the spirit of the invention.

What is claimed:

1. An electrical power strip comprising:

a plurality of electrical outlets for receiving power cord plugs;

a plurality of strap mounts, each strap mount having a connection point associated with one of the plurality of electrical outlets for receiving a strap to releasably secure a power cord plug received by the associated electrical outlet; and a housing defining a connection plane, the housing supporting the plurality of electrical outlets in the connection plane and supporting the plurality of strap mounts such that each strap mount connection point is proximal to the connection plane and to the electrical outlet associated with that strap mount connection point;

wherein the housing comprises a flange extending substantially orthogonal with respect to the connection plane, the strap mounts of the electrical power strip disposed on the flange.

2. The electrical power strip of claim 1, wherein each strap mount comprises an aperture disposed near the connection plane of the housing.

3. The electrical power strip of claim 2, wherein the aperture comprises a slot having a width dimension parallel to the connection plane and a height dimension that is orthogonal to the width dimension, the width dimension being greater than the height dimension.

4. The electrical power strip of claim 3, wherein the width dimension of the slot is greater than the distance separating the connection plane of the housing and the slot.

5. The electrical power strip of claim 1, wherein each strap mount is selected from a group consisting of a hook material, a loop material, a button, a plug, a post, a fastener, a magnet, a releasable adhesive, and a strap.

6. The electrical power strip of claim 1, further comprising a power cord plug electrically coupled to each electrical outlet, wherein the power cord plug of the power strip is adapted for insertion into an electrical wall outlet for providing power to the electrical outlets of the power strip.

7. The electrical power strip of claim 1, wherein adjacent electrical outlets are separated by a predetermined distance, and adjacent strap mounts are separated by the predetermined distance.

8. The electrical power strip of claim 1, wherein the plurality of electrical outlets include at least three electrical outlets.

9. The electrical power strip of claim 1, wherein the electrical outlets are arranged along a longitudinal axis of the housing and the strap mounts are arranged along a mounting axis that is parallel to the longitudinal axis, the mounting axis spaced from the longitudinal axis at least in one direction that is parallel to the connection plane.

10. An electrical power strip assembly comprising:

a plurality of electrical outlets for receiving power cord plugs;

a plurality of strap mounts, each strap mount having a connection point associated with one of the plurality of electrical outlets; and a housing defining a connection plane, the housing supporting the plurality of electrical outlets in the connection plane and supporting the plurality of strap mounts such that each strap mount connection point is proximal to the connection plane and to the electrical outlet associated with that strap mount connection point; and a plurality of straps, each strap configured to releasably secure a power cord plug received by one of the electrical outlets to the associated strap mount at the connection point;

wherein the housing comprises a flange extending in a direction substantially orthogonal with respect to said connection plane, the strap mounts of the electrical power strip disposed along the flange.

11. The electrical power strip assembly of claim 10, wherein each strap mount is selected from a group consisting of a hook material, a loop material, a button, a plug, a post, a fastener, a magnet, a releasable adhesive, and a strap.

12. The electrical power strip assembly of claim 10 further comprising a power cord plug electrically coupled to each electrical outlet, wherein the power cord plug of the power strip is adapted for insertion into an electrical wall outlet for providing power to the electrical outlets of the power strip.

13. The electrical power strip of claim 10, wherein the plurality of electrical outlets include at least three electrical outlets.

14. The electrical power strip assembly of claim 10, wherein a portion of each strap is formed from a hook material and another portion of each strap is formed from a loop material.

15. The electrical power strip assembly of claim 10, wherein each strap includes a mounting portion for mounting to the strap mount at the connection point.

16. The electrical power strip assembly of claim 15, wherein the mounting portion of each strap is selected from a group consisting of a hook material, a loop material, a button, a position adhesive, a connector, an adhesive, a fastener, an aperture, a snap, and a plug.

17. The electrical power strip of claim 10, wherein each strap mount comprises a slot disposed near the connection plane, each slot having a width dimension parallel to the connection plane and a height dimension that is orthogonal to the width dimension, the width dimension being greater than the height dimension.

18. The electrical power strip of claim 17, wherein the width dimension of the slot is greater than the distance separating the connection plane of the housing and the slot.

* * * * *